US006079556A

United States Patent [19]

Draghetti et al.

[11] Patent Number: 6,079,556

[45] Date of Patent: Jun. 27, 2000

[54] PACKET OF CIGARETTES

[75] Inventors: Fiorenzo Draghetti, Medicina; Igino Conti, Bologna, both of Italy

[73] Assignee: G. D Societa' per Azioni, Bologna, Italy

[21] Appl. No.: 09/221,755

[22] Filed: Dec. 28, 1998

[30] Foreign Application Priority Data

Jan. 15, 1998 [IT] Italy ..... BO98A0008

[51] Int. Cl.[7] ..... A24F 16/00

[52] U.S. Cl. ..... 206/268; 206/273; 229/160.1

[58] Field of Search ..... 206/265, 268, 206/271, 273, 264; 229/160.1

[56] References Cited

U.S. PATENT DOCUMENTS 5,323,957 6/1994 Roosa .
5,478,011 12/1995 Pham ..... 229/160.1
5,904,244 5/1999 Focke et al. ..... 206/268

FOREIGN PATENT DOCUMENTS 0 745 541 12/1996 European Pat. Off. .
0 764 594 3/1997 European Pat. Off. .
86 07 391 U 8/1987 Germany .
939 969 10/1963 United Kingdom .
2 175 884 12/1986 United Kingdom .

*Primary Examiner*—David T. Fidei
*Attorney, Agent, or Firm*—Marshll, O'Toole, Gerstein, Murray & Borun

[57] ABSTRACT

A packet of cigarettes, having a cup-shaped container closed by an opening lid and a first, second and third main axis perpendicular to one another, is defined by a number of main walls, each parallel to two of the three main axes, and by at least one connecting wall located between at least two main walls and forming given angles of other than zero with each of the three main axes so as to have a section varying along each of the three main axes.

12 Claims, 2 Drawing Sheets

PACKET OF CIGARETTES

BACKGROUND OF THE INVENTION

The present invention relates to a packet of cigarettes.

Hinged-lid packets of cigarettes normally comprise a container; and a lid hinged to the container and movable between an open and a closed position. Known packets of this type are normally parallelepiped when the lid is closed, are produced on automatic machines from blanks of cardboard or similar material of relatively stable shape, and each comprise an inner cavity housing a group of cigarettes enclosed in wrapping material normally comprising a sheet of foil. The size of the packet and respective cavity is determined according to the size of the group of cigarettes to grip the cigarettes in the group firmly between the walls of the packet and prevent the group from moving with respect to the packet or the cigarettes from moving with respect to the adjacent cigarettes during transport or the numerous transfer operations to which the packets are subjected between the production plant and the user. Unless maintained in a given position, even the slightest movement of the cigarettes inside the packet may result in tobacco fallout and/or bending and/or tearing of the cigarettes.

On the other hand, packets of cigarettes of the above type must also enable easy withdrawal of the cigarettes, particularly when the packet is full, which means allowing a certain amount of clearance between the group and the cavity defined by the walls of the packet, which in turn runs counter to the above necessity of maintaining the group firmly in a given position.

Known packets in fact represent a compromise between these two conflicting requirements, so that neither—firm gripping of the cigarettes and easy withdrawal—is met altogether satisfactorily.

Patent DE-C-583756 relates to a blank having dimpled walls with the convex side of the dimples facing the inner cavity of the packet, and which provide for elastically compressing and so effectively gripping the cigarettes.

The packet described in the above patent has several drawbacks. Firstly, the dimples, formed by permanent deformation of the flat walls of the blank, are not sufficiently elastic to permit easy withdrawal of the cigarettes; and, secondly, dimpled blanks are difficult to process on modern automatic packing machines.

SUMMARY OF THE INVENTION

It is an object of the present invention to provide a hinged-lid packet designed to eliminate the aforementioned drawbacks typically associated with known packets.

In particular, it is an object of the present invention to provide a packet which may be formed from a flat non-three-dimensional blank, and which provides for effectively gripping while at the same time enabling easy withdrawal of the cigarettes.

According to the present invention, there is provided a packet of cigarettes comprising a cup-shaped container and an opening lid for closing the cup-shaped container, and a collar inside the packet; the packet having a first, a second and a third main axis perpendicular to one another, and being defined by a number of main walls, each parallel to two of said three main axes, and by at least one connecting wall; characterized in that said connecting wall is located between at least two said main walls, and forms given angles of other than zero with each of said three main axes so as to comprise a section varying along each of said three main axes.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1B:
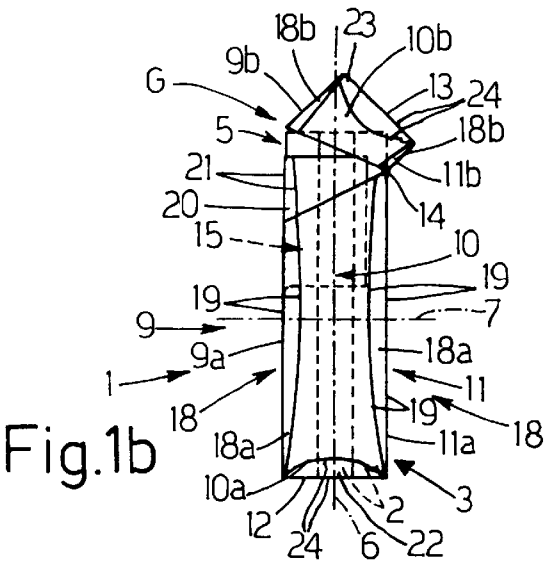
FIGS. 1*a* and 1*b* respectively show a view in perspective and a side view of a first preferred embodiment of a packet in accordance with the present invention.
Figure 1A:
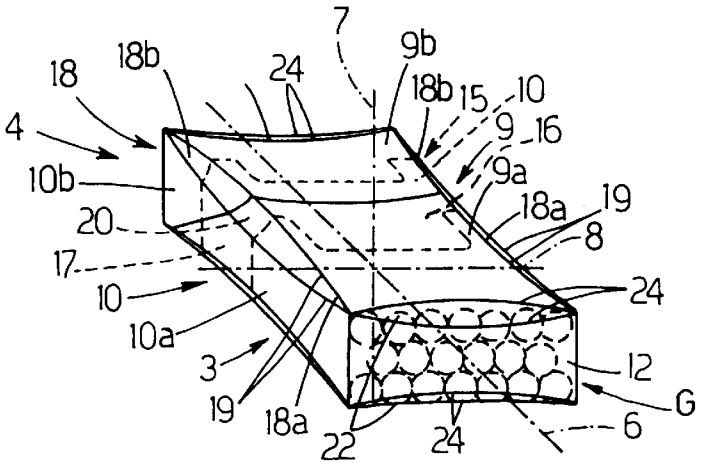

Number 1 in FIGS. 1*a* and 1*b* indicates a packet for housing cigarettes 2, which are shown by the dash lines in FIG. 1*b*, are arranged in a group G, and are enclosed in a known foil wrapping not shown. Packet 1 comprises a cup-shaped container 3, and a lid 4 hinged to container 3 and movable between a closed position (FIG. 1*a*) in which packet 1 is substantially in the form of a parallelepipedon having an inner cavity 5, and an open position permitting access to cavity 5. When lid 4 is closed, packet 1 comprises three main axes 6, 7, 8 perpendicular to one another, and of which axis 6 is a longitudinal axis of symmetry.

Packet 1 comprises six main walls: a front wall 9, two lateral walls 10, a rear wall 11, a bottom wall 12 and a top wall 13. Bottom wall 12 defines a bottom wall of container 3; top wall 13 defines a top wall of lid 4; and the other four walls are divided into two portions 9*a* and 9*b*, 10*a* and 10*b*, 11*a* and 11*b*, the portion indicated by the subscript "a" forming part of container 3, and the portion indicated by the subscript "b" forming part of lid 4.

Walls 11*a* and 11*b* are integral with each other and separated by a virtual hinge 14 defined by a bend line.

Packet 1 also comprises a collar 15, which is indicated by the dash line in FIG. 1*a*, is located inside cavity 5, and comprises a front wall 16 contacting walls 9*a* and 9*b*, and two lateral walls 17 contacting walls 10*a* and 10*b* when lid 4 is closed. Front walls 9 and 16 and rear wall 11 are parallel to one another and to axes 6 and 8; lateral walls 10 and 17 are parallel to one another and to axes 6 and 7; and bottom wall 12 and top wall 13 are parallel to each other and to axes 7 and 8.

Packet 1 also comprises two pairs of outwardly concave connecting walls 18, each of which has the respective convexity facing cavity 5, is substantially lenticular, and extends the whole length of packet 1 measured parallel to axis 6. The walls 18 in each pair of walls 18 are located on opposite sides of a respective lateral wall 10, and connect lateral wall 10 to front wall 9 and rear wall 11 respectively along curved bend lines 19.

Collar 15 comprises two outwardly concave connecting walls 20, which connect front wall 16 to respective lateral walls 17, are separated from walls 16 and 17 by respective curved bend lines 21, and have the respective convexities facing inner cavity 5 of packet 1.

Walls 18 are so shaped that a section of packet 1, crosswise to axis 6 (hereinafter termed "section S6"), varies in area and shape continuously along axis 6 between a maximum area value at walls 12 and 13, and a minimum area value at a substantially intermediate point between walls 12 and 13 along axis 6. Similarly, walls 18 are so shaped that a section of packet 1, crosswise to axis 7 (hereinafter termed "section S7"), varies in area and shape between front wall 9 and rear wall 11; and a section of packet 1, crosswise to axis 8 (hereinafter termed "section S8"), varies in area and shape between lateral walls 10.

Packet 1 also comprises two outwardly concave connecting walls 22 connecting bottom wall 12 to front wall 9*a* and rear wall 11*a* of container 3; and two outwardly concave connecting walls 23 connecting top wall 13 to front wall 9*b* and rear wall 11*b* of lid 4. Walls 22 and 23 are each defined by two curved bend lines 24, which impart a substantially lenticular shape to walls 22 and 23 and continuously vary section S8 along axis 8 between a maximum area value at lateral walls 10, and a minimum area value at a substantially intermediate point between opposite lateral walls 10 along axis 8.

Walls 18, 20, 22, 23 are all characterized in that, with the exception of the portions at minimum area values of sections S6 and S8, planes tangent to each of walls 18, 20, 22, 23 form an angle of other than zero with each of axes 6, 7, 8. Packet 1 provides for effectively compressing group G of cigarettes 2 elastically by virtue of inwardly convex walls 18, 20, 22, 23 defining minimum area values of sections S6 and S8 at the central portion of packet 1, while at the same time, being substantially lenticular-shaped, allowing for greater elasticity and deformation of said central portion to withdraw cigarettes 2 easily.

Figure 2B:
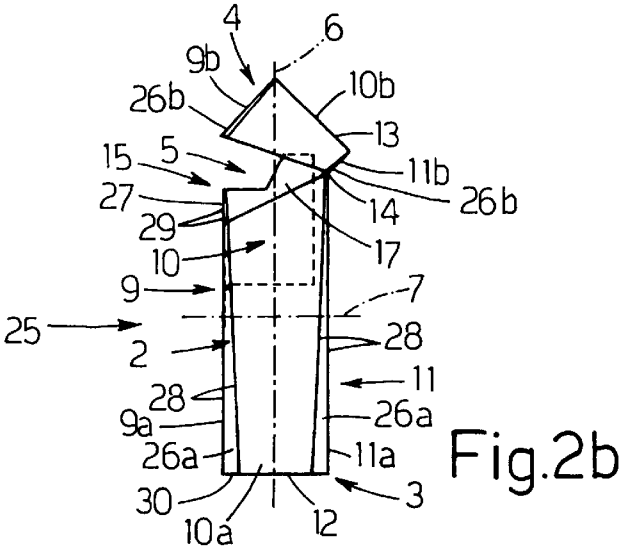
FIGS. 2*a* and 2*b* respectively show a view in perspective and a side view of a second preferred embodiment of a packet in accordance with the present invention.
Figure 2A:
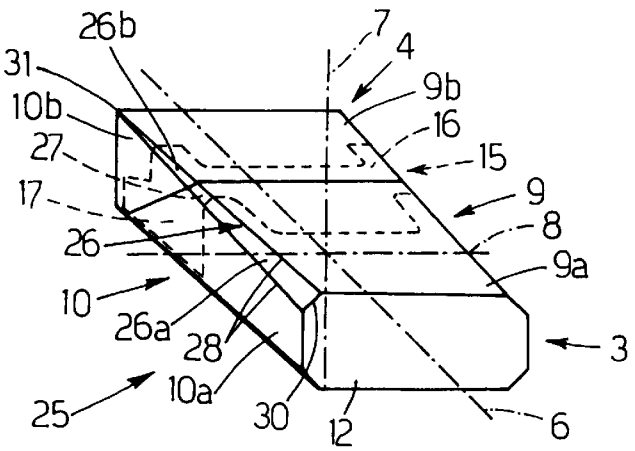

Number 25 in FIGS. 2*a* and 2*b* indicates a packet, the component parts of which are indicated using the same reference numbers as for the corresponding parts of packet 1. In packet 25, outwardly concave connecting walls 18 and 20 and respective curved bend lines 19 and 21 are replaced by flat connecting walls 26 and 27 and by respective straight bend lines 28 and 29; outwardly concave connecting walls 22 and 23 and respective curved bend lines 24 are omitted; and each wall 26 is triangular, extends the whole length of packet 25 measured parallel to axis 6, is defined by a base 30 at the end facing bottom wall 12, and has a vertex 31 at the end facing wall 13.

Connecting walls 26 form an angle of other than zero with each of the three main axes 6, 7, 8, so that sections S6, S7, S8 of packet 25 vary along respective main axes 6, 7, 8. In particular, section S6 varies in shape and size along axis 6 between a minimum area value of section S6 at bottom wall 12, and a maximum area value of section S6 at top wall 13.

Packet 25 is particularly advantageous as regards walls 26, which, together with walls 9, 10 and 11, and especially close to bottom wall 12, provide for firmly compressing and so effectively gripping group G of cigarettes; which compression decreases along axis 6 towards top wall 13, where section S6 is larger, thus enabling easy withdrawal of cigarettes 2 from container 3.

Figure 3B:
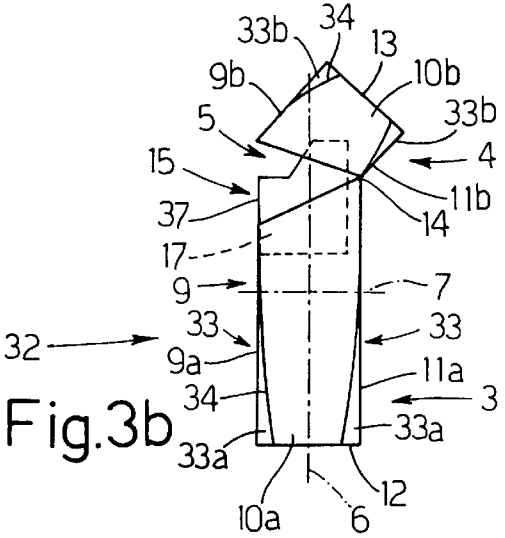
FIGS. 3*a* and 3*b* respectively show a view in perspective and a side view of a third preferred embodiment of a packet in accordance with the present invention.
Figure 3A:
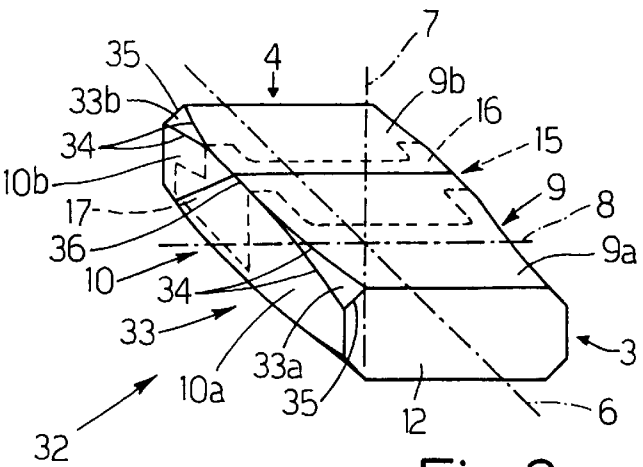

Number 32 in FIGS. 3*a* and 3*b* indicates a packet similar to packet 25, and the component parts of which are indicated using the same reference numbers as for the corresponding parts of packet 25.

In packet 32, walls 26 and respective bend lines 28 are each replaced by a wall indicated as a whole by 33, and which is divided into two separate portions 33*a* and 33*b* formed respectively on container 3 and lid 4. Each wall 33*a*, 33*b* is in the form of a triangle defined by two lateral bend lines 34, and by a base line 35 extending along an inclined edge of bottom wall 12 or top wall 13. Lines 34 in each pair of lines 34 converge at a respective edge 36 laterally defining a respective wall 10.

Each wall 33 forms an angle of other than zero with each of the main axes 6, 7, 8, so that sections S6, S7, S8 of packet 32 vary along respective main axes 6, 7, 8. Besides effectively gripping group G at the end portions of packet 32 and enabling easy withdrawal of cigarettes 2 from cavity 5 when lid 4 is opened, packet 32 is particularly advantageous by enabling elimination of the inclined connecting walls of collar 15, which may comprise straight edges 37 extending along edges 36 between front wall 9 and lateral walls 10.

Figure 4B:
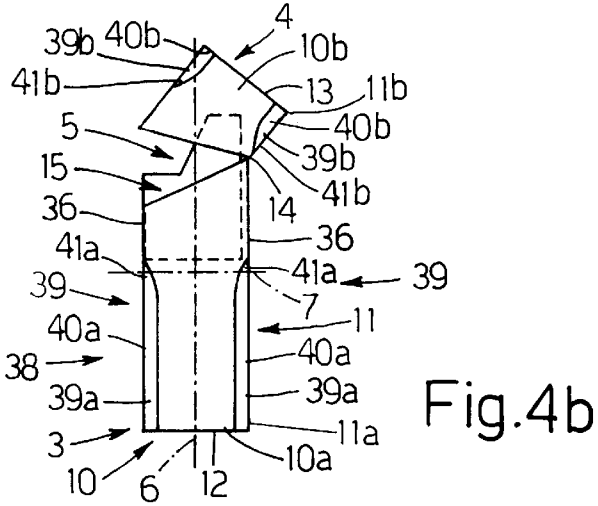
FIGS. 4*a* and 4*b* respectively show a view in perspective and a side view of a fourth preferred embodiment of a packet in accordance with the present invention.
Figure 4A:
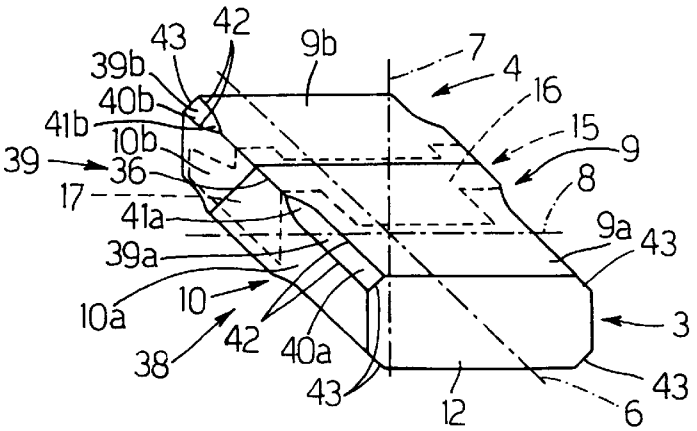

Number 38 in FIGS. 4*a* and 4*b* indicates a variation of packet 32, in which each connecting wall 33 is replaced by a connecting wall indicated as a whole by 39 and divided into two separate portions 39*a* and 39*b* formed respectively on container 3 and lid 4. Walls 39*a* and 39*b* comprise respective portions 40*a* and 40*b* parallel to axis 6, and respective portions 41*a* and 41*b* connected to respective portions 40*a* and 40*b* and forming an angle of other than zero with each of main axes 6, 7, 8.

Each wall 39*a*, 39*b* is cusp-shaped and defined by two lateral bend lines 42, and by a base line 43 extending along an inclined edge of bottom wall 12 or top wall 13; and lines 42 in each pair of lines 42 converge at a respective edge 36.

In the above variation, sections S6, S7, S8 vary along respective axes 6, 7, 8. In particular, section S6 assumes a minimum constant value along respective portions of axis 6 at bottom wall 12 and top wall 13 to effectively grip group G, and a maximum constant value along a central portion of axis 6 to enable easy withdrawal of cigarettes 2.

As will be obvious from the foregoing description, further variations, even though not described, are also possible. In particular, any variation involving the formation of at least one connecting wall inclined or partially inclined with respect to axes 6, 7, 8 between two main walls 9, 10, 11, 12, 13, or any combination of connecting walls inclined with respect to main axes 6, 7, 8 provides for achieving the object of the present invention.

We claim:

1. A packet of cigarettes comprising a cup-shaped container (3), an opening lid (4) for closing the cup-shaped container (3), and a collar (15) inside the packet (1;25;32;38); the packet (1;25;32;38) having a first (6), a second (7) and a third (8) main axis perpendicular to one another, and being defined by a number of main walls (9,10,11,12,13), each parallel to two of said three main axes (6,7,8), and by at least one connecting wall (18;22;23;26;33;39), the packet having respective sections perpendicular respectively to each of said main axes (6,7,8); wherein said connecting wall (18;22;23;26;33;39) is located between at least two said main walls (9,10,11,12,13), and at least a portion of said connecting wall forms given angles of other than zero with each of said three main axes (6,7,8) so said respective sections vary in area and shape along each of said three main axes (6;7;8).

2. A packet as claimed in claim 1, wherein said connecting wall (18;22;23;26;33;39) is a flat connecting wall (26;33).

3. A packet as claimed in claim 1, wherein said connecting wall (18;22;23;26;33;39) is an outwardly concave and inwardly convex wall (18;22;23;39) with the convexity facing an inner cavity (5) of the packet (1;38).

4. A packet as claimed in claim 1 comprising at least four said connecting walls (18;26;33;39) located symmetrically about said first main axis (6).

5. A packet as claimed in claim 1, wherein said first main axis (6) is a longitudinal axis of said container (3) and said lid (4).

6. A packet as claimed in claim 4 comprising four said connecting walls (22,23) located symmetrically about the third main axis (8).

7. A packet as claimed in claim 1, wherein each said connecting wall (18;26) extends the whole length of the packet measured parallel to said first main axis (6).

8. A packet as claimed in claim 1, wherein each said connecting wall (26,33) is substantially triangular.

9. A packet as claimed in claim 1, wherein each said connecting wall (18;22;23) is substantially lenticular.

10. A packet as claimed in claim 5, wherein each said connecting wall (18;26;33;39) comprises a first portion **(18*a*;26*a*;33*a*;39*a*) extending substantially along said cup-shaped container (3), and a second portion (18*b*;26*b*;33*b*;39*b*) extending substantially along said lid (4)**.

11. A packet as claimed in claim 10 comprising at least two edges (36) formed between a front wall (9) and respective lateral walls (10); said edges (36) extending parallel to the first main axis (6) between said first portion **(33*a*;39*a*) and said second portion (33*b*;39*b*) at said collar (15)**.

12. A packet of cigarettes comprising a cup-shaped container (3), an opening lid (4) for closing the cup-shaped container (3), and a collar (15) inside the packet (1;25;32;38); the packet (1;25;32;38) having a first (6), a second (7) and a third (8) main axis perpendicular to one another, and being defined by a number of main walls (9,10,11,12,13), each parallel to two of said three main axes (6,7,8), and by at least one connecting wall (18;22;23;26;33;39), the packet having respective sections perpendicular respectively to each of said main axes (6,7,8); wherein said connecting wall (18;22;23;26;33;39) is located between at least two said main walls (9,10,11,12,13), and at least a portion of said connecting wall forms given angles of other than zero with each of said three main axes (6,7,8) so said respective sections vary in area and shape along each of said three main axes (6,7,8); said connecting wall extending along one of the main axes (6,7,8) for at least one third of the length of the packet along said main axis (6;7;8).

* * * * *